US008635937B2

(12) United States Patent
Angeloff et al.

(10) Patent No.: US 8,635,937 B2
(45) Date of Patent: Jan. 28, 2014

(54) SYSTEMS AND METHODS FOR LAUNCHING MUNITIONS

(75) Inventors: Mark A. Angeloff, Indianapolis, IN (US); Roy P. McMahon, Indianapolis, IN (US)

(73) Assignee: Raytheon Company, Waltham, MA (US)

( * ) Notice: Subject to any disclaimer, the term of this patent is extended or adjusted under 35 U.S.C. 154(b) by 343 days.

(21) Appl. No.: 12/875,797

(22) Filed: Sep. 3, 2010

(65) Prior Publication Data

US 2012/0055322 A1 Mar. 8, 2012

(51) Int. Cl.
*F41F 3/04* (2006.01)

(52) U.S. Cl.
USPC ..... 89/1.811; 89/1.816

(58) Field of Classification Search
USPC ..... 89/1.8, 1.811, 1.816
See application file for complete search history.

(56) References Cited

U.S. PATENT DOCUMENTS

| | | | | | |
|---|---|---|---|---|---|
| 2,398,871 | A | | 4/1946 | Turnbull et al. | |
| 2,844,073 | A | | 7/1958 | Re et al. | |
| 2,964,587 | A | * | 12/1960 | Minot | 174/117 A |
| 3,072,021 | A | * | 1/1963 | Marcon | 89/1.811 |
| 3,136,842 | A | * | 6/1964 | Perkins et al. | 174/88 R |
| 3,266,423 | A | * | 8/1966 | Simpson | 102/504 |
| 3,342,104 | A | | 9/1967 | Aime | |
| 3,412,640 | A | | 11/1968 | Nash | |
| 3,988,961 | A | | 11/1976 | Banta et al. | |
| 4,099,038 | A | * | 7/1978 | Purdy | 200/61.08 |
| 4,455,917 | A | | 6/1984 | Shook | |
| 4,464,972 | A | * | 8/1984 | Simon | 89/1.816 |
| 4,635,527 | A | | 1/1987 | Carrier et al. | |
| 4,770,370 | A | * | 9/1988 | Pinson | 244/3.12 |
| 5,058,481 | A | | 10/1991 | Drummond et al. | |
| 5,564,649 | A | * | 10/1996 | von Hoessle et al. | 244/3.12 |
| 6,868,769 | B1 | * | 3/2005 | Wright | 89/1.811 |
| 2007/0234922 | A1 | | 10/2007 | Van Laar et al. | |

FOREIGN PATENT DOCUMENTS

| | | | |
|---|---|---|---|
| FR | 2866105 | A1 | 8/2005 |
| GB | 2 176 881 | A | 1/1987 |
| WO | 2010/065639 | A1 | 6/2010 |

OTHER PUBLICATIONS

International Search Report and Written Opinion for copending International Application No. PCT/US2011/049272 dated Nov. 25, 2011.

Machine Translation of FR 2866105 A1, Aug. 12, 2005.

* cited by examiner

*Primary Examiner* — Gabriel Klein

(74) *Attorney, Agent, or Firm* — Renner, Otto, Boisselle & Sklar, LLP

(57) ABSTRACT

Systems and methods for launching munitions are provided. In some embodiments, the system may include a launcher coupled to a vehicle and configured to retain a munition during transport by a vehicle and configured to route electrical signals from the vehicle to the munition. The system may also include a flexible, peel-away connector coupled to the launcher, the peel-away connector comprising an adhesive for coupling to at least a portion of the munition. The flexible, peel-away connector may be configured to route electrical signals from the launcher to the munition during transport and detach from the munition as the munition exits from the launcher during a launch.

13 Claims, 5 Drawing Sheets

SYSTEMS AND METHODS FOR LAUNCHING MUNITIONS

TECHNICAL FIELD

The present disclosure relates to munitions, and in particular, systems and Methods for launching munitions.

BACKGROUND

Munitions such as air to ground missiles (AGM), air to air missiles (AAM), and rockets (e.g., smart rockets) can be carried and launched from various vehicle types including aircraft vehicles (e.g., fighter jets, helicopters, etc.,), land vehicles (e.g., tanks), and/or watercraft (e.g., aircraft carrier, submarines, etc.). Launchers, fixed to the vehicle, may be used to secure the munitions during transportation as well as used to deploy the munitions. Conventional munition launchers include a rail structure for holding the munitions and electromechanical apparatus for fixing the munitions to the launcher. A release mechanism arms the munitions and releases it for launching. For example, the launcher may include power supply equipment that controls the fusing and firing of the munitions.

Conventional munition launchers have many drawbacks. For example, the electromechanical apparatus that supports and separates the munitions from the launcher during deployment are often bulky and heavy. Additionally, the electromechanical apparatus can sometime interfere with electrical interconnections between the munitions and the launcher.

SUMMARY

The present disclosure provides techniques for launching munitions that substantially eliminates or reduces at least some of the disadvantages and problems associated with previous methods and systems.

In some embodiments, a system for launching munitions is provided. The system may include a launcher coupled to a vehicle and configured to retain a munition during transport by a vehicle and configured to route electrical signals from the vehicle to the munition. The system may also include a flexible, peel-away connector coupled to the launcher, the peel-away connector comprising an adhesive for coupling to at least a portion of the munition. The flexible, peel-away connector may be configured to route electrical signals from the launcher to the munition during transport and detach from the munition as the munition exits from the launcher during a launch.

In other embodiments, a launcher configured to retain a munition during transport by a vehicle is provided. The launcher may include a flexible, peel-away connector comprising an adhesive for coupling to at least a portion of the munition. The flexible, peel-away connector may be configured to route electrical signals from the launcher to the munition during transport and detach from the munition as the munition exits from the launcher during a launch.

In some embodiments, a method for launching a munition from a launcher coupled to a vehicle is provided. The method may includes steps for adhering a flexible, peel-away connector to the munition, coupling the peel-away connector to a contact point of the launcher, routing electrical signals from the launcher to the munition during transport, and detaching the peel-away connector from the munition as the munition exits from the launcher during a launch.

The systems and methods of the present disclosure provide a non-mechanical, cost-effective communication channel to munitions during transportation and allow for a seamless disconnect from the communication channel upon launching of the munitions. Other technical advantages will be readily apparent to one skilled in the art from the following figures, descriptions, and claims. Moreover, while specific advantages have been enumerated above, various embodiments may include all, some or none of the enumerated advantages.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1A through 4B, wherein like numbers are used to indicate like and corresponding parts.

Figure 1A:
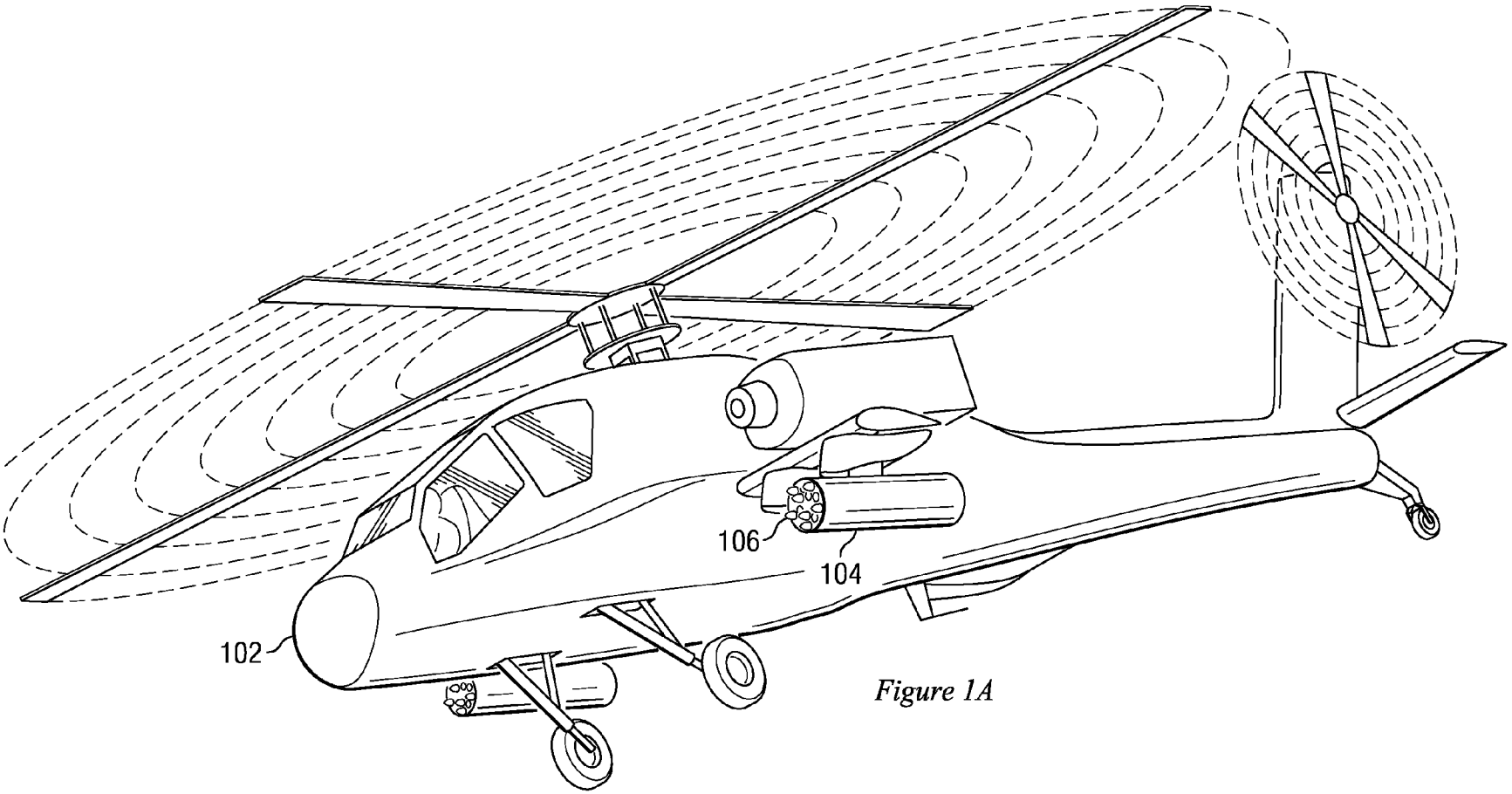
FIG. 1A illustrates an aircraft vehicle with a launcher transporting munitions, in accordance with one embodiment of the present disclosure.

FIG. 1A illustrates an example vehicle 102 that includes a launcher 104, in accordance with certain embodiments of the present disclosure. Vehicle 102 may be an aircraft vehicle such as a helicopter, an unmanned aerial system (UAS), unmanned undersea systems (UUS), fighter jets (e.g., F-16, F/A-18, etc.) and/or other aircraft vehicles configured to transport and launch munitions. While FIG. 1 illustrates an aircraft vehicle, other vehicles are also contemplated. For example, vehicle 102 may be a land vehicle (e.g., tankers, transporter erector launchers, and/or military vehicles), a watercraft vehicle (e.g., submarines, surface ships, etc.) or other suitable vehicle.

Launcher 104 coupled to vehicle 102 may be configured to house munitions 106 during transport. In some embodiments, launcher 104 may also provide continuous electrical contact between each of munitions 106 and a user (e.g., pilot of vehicle 102, mission control in communication with vehicle 102, etc.). Launcher 104 may also include a peel-away connector configured to secure the electrical contact to munitions 106. When munitions 106 is launched, the peel-away connector may "peel away" from munitions 106, disconnecting the electrical contact and allowing munitions 106 to exit launcher 104. Details of launcher 104 are described below with respect to FIGS. 1B, 2, and 3.

In some embodiments, during deployment of vehicle 102, a user (e.g, a pilot of vehicle 102 or mission control remotely located from vehicle 102 and in communication with vehicle 102) may launch munitions 106 by communicating with munitions 106 via the electrical components provided by launcher 104. The electrical components may provide signals that include the coordinate information of a specific target and/or other information that allows munitions 106 to accurately strike the target, reducing or substantially eliminating incidental or collateral damages.

Figure 1B:
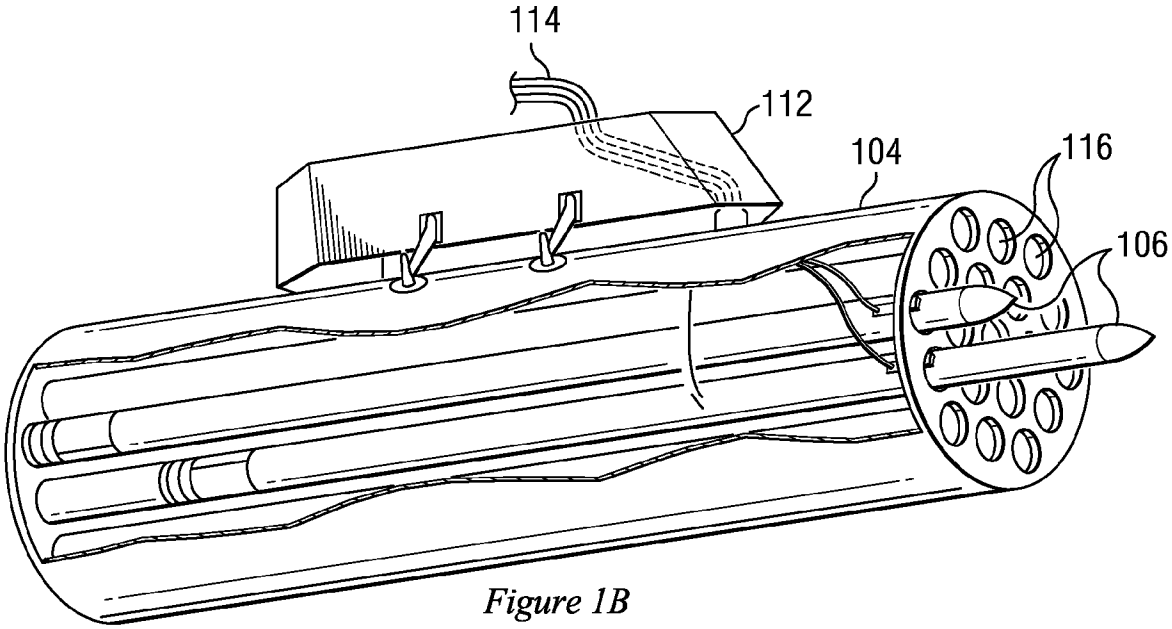
FIG. 1B illustrates the launcher of FIG. 1A, in accordance with one embodiment of the present disclosure.

FIG. 1B illustrates an example launcher 104 configured to secure munitions 106 during transportation and provide continuous electrical contact to munitions 106 until time of launch, in accordance with certain embodiments of the present disclosure. In some embodiments, launcher 104 may be a LAU-61, LAU-68, M260, M261, M299, or M279 type launcher. In other embodiments, launcher 104 may be an expendable bucket type launcher. Launcher 104 may be configured to house munitions 106 in openings 116. Launcher 104 may also include optional housing 112 configured to enclose electrical components 114 that couple with munitions 106. It is noted that launcher 104 shown in FIG. 1B is an example. Other suitable types of apparatuses or system configured to launch a munition are contemplated.

Optionally housing 112, which may integrally formed as a part of launcher 104 or may be secured to launcher 104, may be any enclosure coupled between launcher 104 and vehicle 102. In some embodiments, housing 112 may enclose one or more electrical components 114 disposed therein and may route the appropriate electrical components to each munition 106 in housing 112.

Electrical components 114 may be one or more electrical transmission wires or cables and/or any other transmission component configured to provide a communication channel between a user (e.g., a pilot or mission control in communication with vehicle 102) and munition 106. In some embodiments, electrical components 114 may transmit signals sent from a user to one or more munitions 106, where the signals provide details about a launching including, for example, GPS coordinates of a target, launch time, etc.

In some embodiments, electrical components 114 are coupled to munition 106 at contact point 118 (shown in FIG. 1C) and is coupled with peel-away connector 108. During the transportation of munition 106, peel-away connector 108 (shown in FIGS. 2A and 2B) may allow electrical components to remain in continuous contact with munition 106. Upon the launching of a munition 106, as munition 106 leaves launcher 104, peel-away connector 108 may "peel back" from munition 106, allowing electrical components 114 to physically and electronically disconnect from munition 106. Details of peel-away connector 108 is described below with respect to FIG. 2.

Figure 1C:
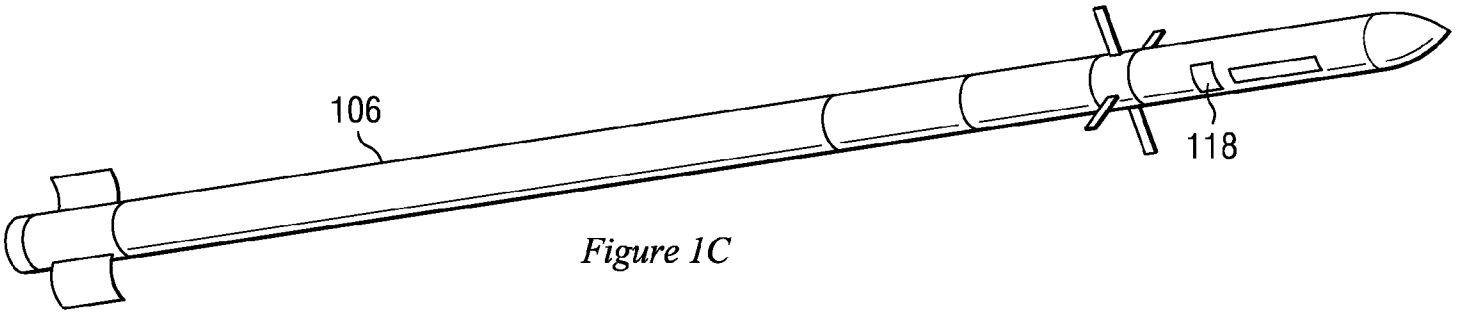
FIG. 1C illustrates an example munitions for use in conjunction with the launcher of FIG. 1A.

FIG. 1C illustrates an example of a munition 106, in accordance with embodiments of the present disclosure. Munition 106 may be a precision-guided munition (PGs), smart bomb, smart weapon, guided bomb unit (GBU), guided missile (e.g., laser guided missile, infrared guided missile, etc.), smart rocket, and/or other weapon that may include electronics. Munition 106, as directed by commands sent via electrical components by the pilot or mission control in communication with vehicle 102, may be configured to precisely hit a specific target to reduce collateral damage. In order to receive the signals transmitted by electrical components 114, munition 106 may include one or more contacts points 118. For example, contact point 118 may be part of a guidance and control (G&C) unit of the munitions. For example, signals received via electrical components 114 at contact points 118 may be provided to other components of the G&C, such as a signal processing unit, a global positioning system (GPS), an inertial measurement units (IMUs) configured to provide needed inertial guidance to the munitions, imaging system, and/or other components. One or more of the components of the G&C unit of munition 106 may be used to precisely guide munition 106 when launched.

Figure 2:
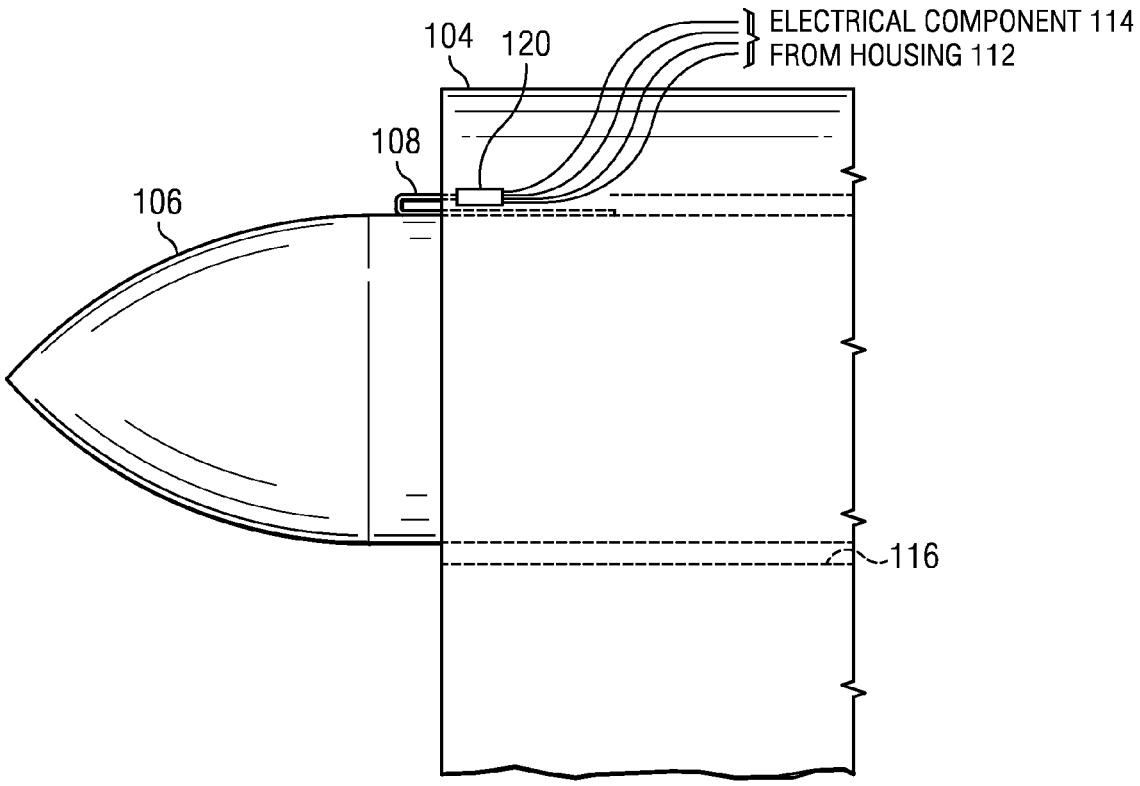
FIG. 2 show a side-profile view of a launcher with a peel-away connector coupled to a munition, in accordance with one embodiment of the present disclosure.

FIG. 2 illustrates a profile view of launcher 104 including peel-away connector 108 coupled to munition 106, in accordance with embodiments of the present disclosure. Peel-away connector 108, coupled to launcher 104, and more specifically, to the inside of opening 116, may be a ribbon that includes an adhesive material that secures connector 108 between contact point 120 of launcher 104 and contact point 118 of munition 106. Contact point 120 may include electrical adaptor or interface configured to connect electrical components 114 to connector 108. In some embodiments, contact point 120 may be small computer system interface (SCSI), MIL-C-5015 connector, MIL-C-26482 connector, MIL-C-38999 connector, MIL-C-24308 connector, MIL-C-81511 connector, MIL-DTL-83513 connector, MIL-C-38300 connector, non-circular connectors with small gauge tubular contact designs, either a male or female electrical connector configured to receive a corresponding part from electrical components 114, and/or other adaptors, connectors, and/or interfaces.

Peel-away connector 108 may allow for continuous communication between the pilot of vehicle 102 and/or mission control in communication with vehicle 102 during the transport of munition 106. For example, peel-away connector 106 may include, at least in some portions, a polyimide adhesive film, an epoxy adhesive film, or other flexible, heat-tolerant, adhesive film(s) that may secure electrical connectors 114 to munition 106 during transport and may be detachable from munitions 106 during a munition launch. Peel-away connector 108 may include one or more embedded conductors 110 configured to conduct electrical signals between contact point 118 of munition 106 and contact point 120 of launcher 104.

Figure 3:
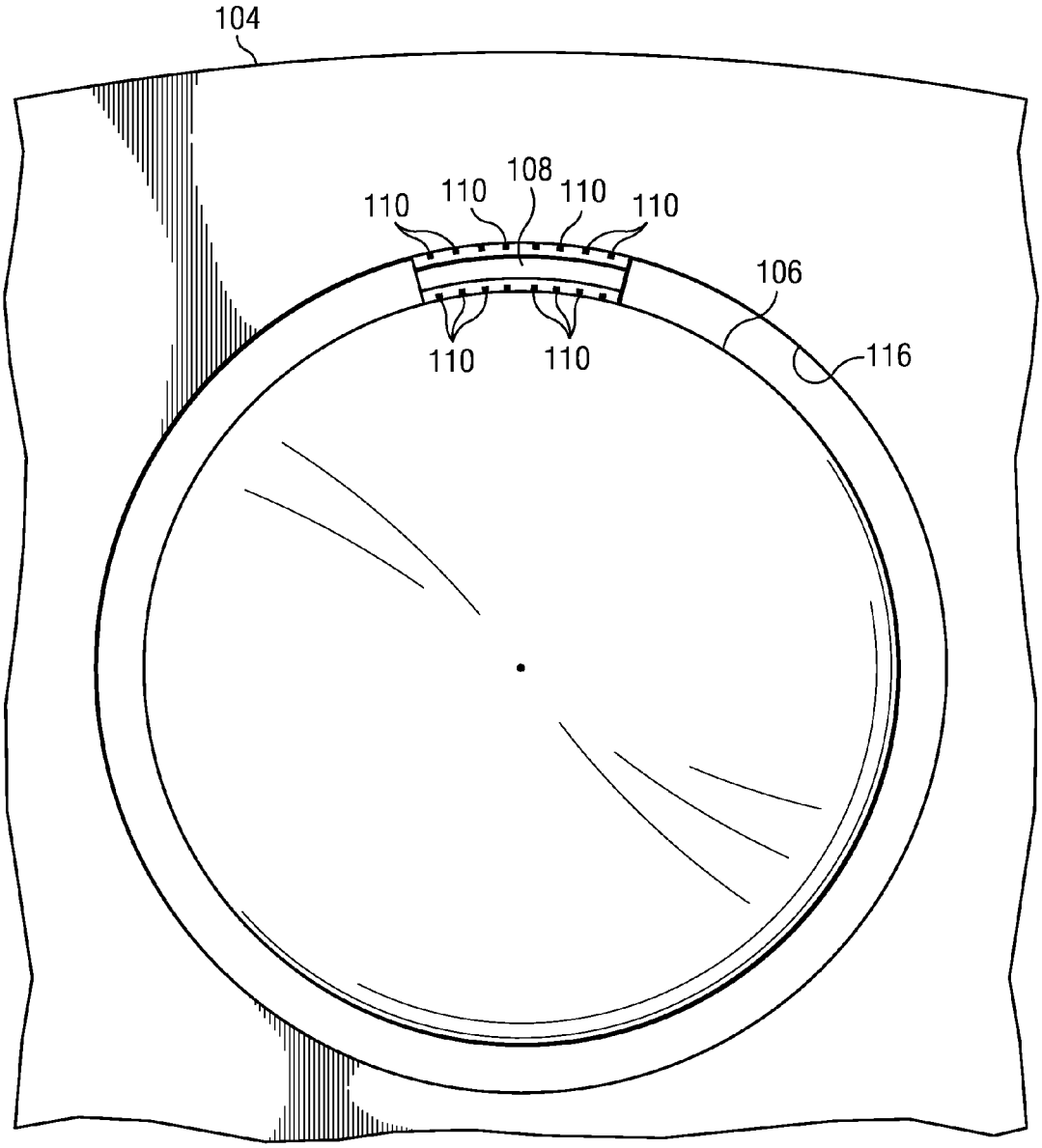
FIG. 3 shows a cross-sectional view of a launcher with a peel-away connector coupled to a munition, in accordance with one embodiment of the present disclosure.

Referring to FIG. 3, a cross-sectional view of launcher 104 and munition 106 is shown, in accordance with certain embodiments of the present disclosure. Munition 106, secured in launcher 104, and specifically in opening 116 of launcher 104, may be in continuous contact with vehicle 102 and/or mission control in contact with vehicle 102. In some embodiments, a connector 108 is provided and may include one or more embedded conductors 110 configured to conduct electrical signals between contact point 118 of munition 106 and contact point 120 of launcher 104. The electrical signals communicated between contact point 118 and contact point 120 may include, for example, GPS coordinates of a target, launch time, and/or other mission-specific information regarding the intended target.

Figure 4A:
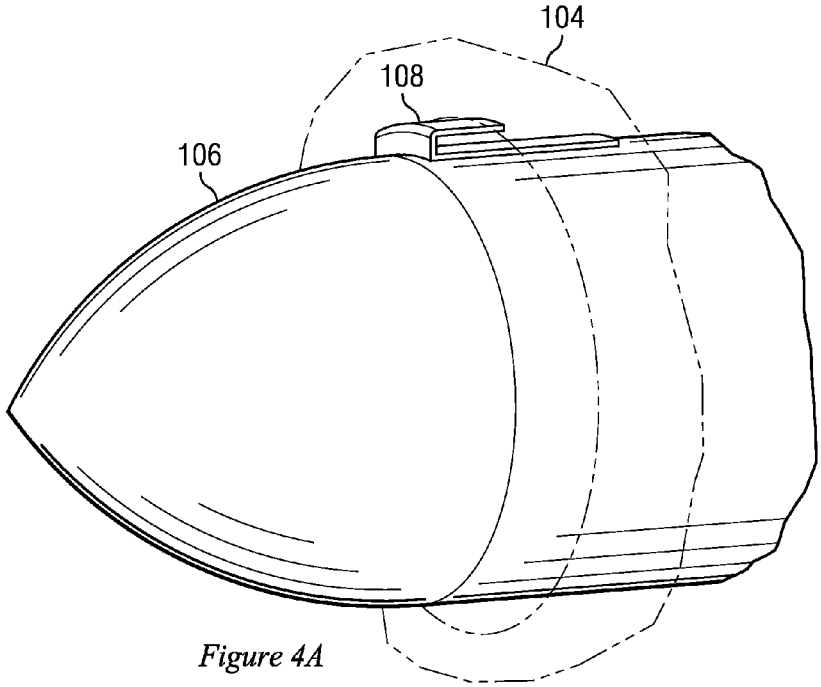
FIGS. 4A and 4B show a side-profile view of a launcher with a peel-away connector coupled to a munition before and during a launch, respectively, in accordance with one embodiment of the present disclosure.
Figure 4B:
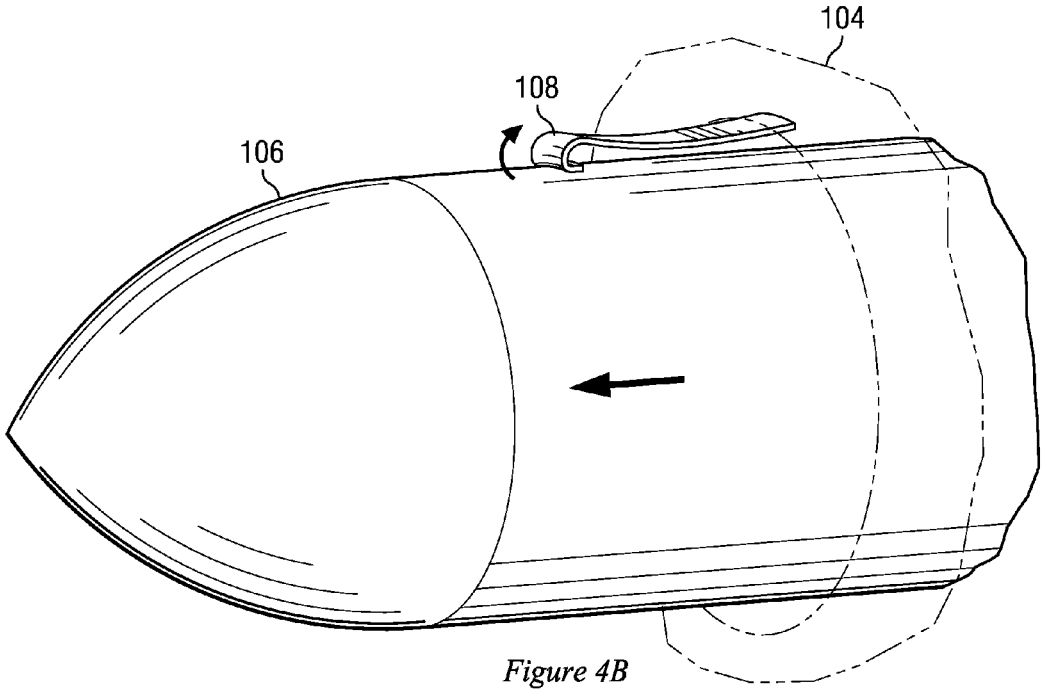

At time of launch, after appropriate signals s and/or other information are sent to munition 106, launcher 104 may launch munition 106. Referring to FIGS. 4A and 4B, up until the launching of munition 106, peel-away connector 108 may remain in physical and electrical contact with munition 106. As munition 106 exits launcher 104, propulsion forces may cause peel-away connector 108 to "peel back" and detach from munition 106, as shown in FIG. 4B.

Although the figures and embodiments disclosed herein have been described with respect to information handling systems, it should be understood that various changes, substitutions and alternations can be made herein without departing from the spirit and scope of the disclosure as illustrated by the following claims.

What is claimed:

1. A system for launching munitions from a vehicle, the system comprising:

a launcher coupled to a vehicle and configured to retain a munition during transport by a vehicle, the launcher configured to route electrical signals from the vehicle to the munition;

the launcher having a first point of contact and the munition having a second point of contact on the body of the munition; and a flexible, peel-away connector extending in the launch direction from a first end portion to a second end portion, the peel-away connector coupled to the launcher at the first point of contact, the peel-away connector comprising a detachable adhesive film for adhesively coupling to at least a portion of the munition at the second point of contact, wherein the first end portion of the peel-away connector is adhesively attached to the munition at the second point of contact, and the second end portion is coupled to the launcher, the second end portion being folded back over the adhesively attached first end portion in a direction opposite the launch direction and being not adhesively attached to the munition, the peel-away connector configured to:

route electrical signals from the launcher to the munition during transport, wherein the munition receives the electrical signals at the second point of contact; and adhesively decouple completely from the body of the munition at the second point of contact by peeling back in a direction opposite the launch direction toward the launcher as the munition exits from the launcher during a launch.

2. The system according to claim 1, the peel away connector comprising a polyimide adhesive film or an epoxy adhesive film.

3. The system according to claim 1, wherein the vehicle comprises an unmanned vehicle, an aircraft vehicle, a land vehicle, or a watercraft vehicle.

4. The system according to claim 1, wherein the munition is a precision-guided munition (PGM), a smart bomb, a smart weapon, a guided bomb unit (GBU), a guided missile, or a smart rocket.

5. The system according to claim 1, wherein the peel-away connector further comprises at least one embedded conductor configured to conduct the electrical signals between the first contact point of the launcher and the second contact point of the munition.

6. A launcher, comprising:

a launch tube configured to retain a munition during transport by a vehicle;

the launch tube having a first point of contact and the munition having a second point of contact on the body of the munition;

a flexible, peel-away connector extending in the launch direction from a first end portion to a second end portion, the peel-away connector coupled to the launcher at the first point of contact, the peel-away connector comprising a detachable adhesive film for adhesively coupling to at least a portion of the munition at the second point of contact, wherein the first end portion of the peel-away connector is adhesively attached to the munition at the second point of contact, and the second end portion is coupled to the launcher, the second end portion being folded back over the adhesively attached first end portion in a direction opposite the launch direction and being not adhesively attached to the munition, the peel-away connector configured to:

route electrical signals from the launcher to the munition during transport, wherein the munition receives the electrical signals at the second point of contact; and adhesively decouple completely from the body of the munition at the second point of contact by peeling back in a direction opposite the launch direction toward the launcher as the munition exits from the launcher during a launch.

7. The launcher according to claim 6, the peel-away connector comprises a polyimide adhesive film or an epoxy adhesive film.

8. The launcher according to claim 6, wherein the vehicle comprises an unmanned vehicle, an aircraft vehicle, a land vehicle, or a watercraft vehicle.

9. The launcher according to claim 6, wherein the munition is a precision-guided munition (PGM), a smart bomb, a smart weapon, a guided bomb unit (GBU), a guided missile or a smart rocket.

10. A method for launching a munition from a launcher coupled to a vehicle, the method comprising:

coupling a flexible, peel-away connector to a first contact point of the launcher;

adhering the flexible, peel-away connector comprising an elongated ribbon extending from a first end portion to a second end portion and a detachable adhesive film to the body of the munition at a second point of contact; wherein the first end portion of the peel-away connector is adhesively attached to the munition at the second point of contact, and the second end portion is coupled to the launcher, the second end portion being folded back over the adhesively attached first end portion in a direction opposite the launch direction and being not adhesively attached to the munition, routing electrical signals between the first contact point of the launcher to the second contact point of the munition during transport; and adhesively decoupling completely from the body of the munition at the second point of contact by peeling back in a direction opposite the launch direction toward the launcher as the munition exits from the launcher during a launch.

11. The method according to claim 10, the peel-away connector comprises a polyimide adhesive film or an epoxy adhesive film.

12. The method according to claim 10, wherein the peel-away conductor comprises at least one embedded conductor, and wherein the method further comprises conducting the electrical signals between the first contact point of the launcher and the second contact point of the munition via the at least one embedded conductor.

13. The method according to claim 10, wherein coupling the peel-away connector to the first contact point of the launcher comprises coupling the peel-away connector to an adaptor or interface of the launcher.

* * * * *